US005820063A

United States Patent [19]

Fissman et al.

[11] Patent Number: 5,820,063

[45] Date of Patent: Oct. 13, 1998

[54] METHOD FOR THE WINDING UP OF A LONGITUDINALLY CUT WEB OF MATERIAL, AND APPARATUS FOR CARRYING OUT THIS METHOD

[75] Inventors: Hans-Joachim Fissman, Konstanz; Matthias Wohlfahrt, Ulm, both of Germany

[73] Assignee: Voith Sulzer Papiermaschinen, Heidenheim, Germany

[21] Appl. No.: 804,898

[22] Filed: Feb. 24, 1997

[30] Foreign Application Priority Data

Feb. 23, 1996 [DE] Germany ..... 196 06 758.8

[51] Int. Cl.[6] ..... B65H 18/20; B65H 18/26

[52] U.S. Cl. ..... 242/530.4; 242/541.7; 242/542; 242/908

[58] Field of Search ..... 242/530, 530.4, 242/541.7, 542, 542.4, 908

[56] References Cited

U.S. PATENT DOCUMENTS

| | | | |
|---|---|---|---|
| 3,346,209 | 10/1967 | Cronin | 242/541.7 |
| 3,497,151 | 2/1970 | Voss et al. | 242/541.7 |
| 3,515,183 | 6/1970 | Voss | 242/541.7 |
| 4,732,341 | 3/1988 | Ruff . | |
| 4,749,140 | 6/1988 | Ruff | 242/530 |
| 5,360,180 | 11/1994 | Welp et al. | 242/908 |
| 5,492,287 | 2/1996 | Raudaskoski et al. | 242/542 |
| 5,562,261 | 10/1996 | Beisswanger et al. | 242/541.7 |

FOREIGN PATENT DOCUMENTS

| | | |
|---|---|---|
| 1047001 | 12/1958 | Germany . |
| 9201791 | 5/1992 | Germany . |
| 4409036 | 9/1995 | Germany . |
| 9414449 | 2/1996 | Germany . |

*Primary Examiner*—John M. Jillions
*Attorney, Agent, or Firm*—Ostrolenk, Faber, Gerb & Soffen, LLP

[57] ABSTRACT

A web winding machine includes two roll beds each formed of two roll support rollers. Each bed receives a respective web roll being wound thereon. The web rolls are at separate locations across the width of the machine. For at least one roll bed, a longitudinally extending packing is introduced from below into the gap between the two support rollers of the bed. A respective movable packing element is at the end of each wound roll and forms a packing gap with the wound roll and with the wall surfaces of the support rollers to enclose a pressure space. A compressed air cushion can be built up below the wound roll in the bed. At least one of the rollers of the roll bed has a perforated roller shell. A stationary pressure chamber inside the shell delivers pressure through the shell into the pressure space. The pressure chamber in the shell can be divided into sections along the axis of the roller. The pressure chamber is adapted to be connected to a source of compressed air. Brackets for supporting each wound roll are disclosed.

19 Claims, 5 Drawing Sheets

METHOD FOR THE WINDING UP OF A LONGITUDINALLY CUT WEB OF MATERIAL, AND APPARATUS FOR CARRYING OUT THIS METHOD

BACKGROUND OF THE INVENTION

The present invention relates to a method for winding up a longitudinally cut web of material, for instance a longitudinally cut web of paper, in which wound rolls which are produced from the partial webs are supported by two roll beds formed of roll support rollers. The invention further relates to apparatus for carrying out this method. The apparatus is preferably developed as a three roller roll winding machine. Theoretically, the two roll beds could also be formed from four roll support rollers.

Federal Republic of Germany 35 41 906 discloses a three roller roll cutting machine. The three roll support rollers form two roll beds for enabling the partial webs produced by the longitudinal cutting of the continuous web to be wound to form rolls partly on one roll bed and partly on the other roll bed. Each individual wound roll produced on a roll tube is guided by means of two roll brackets. Each roll bracket has a vertically movable tube guide in which a clamping head is rotatably supported. The two clamping heads engage slightly into the tube of the roll at the two ends of the resultant wound roll. This construction makes it possible to counteract the weight of the wound roll by operation of the vertically movable tube guide. In other words, this relieves the weight of the wound roll so that its full weight no longer rests on the roll support rollers. This attempts to counteract the risk that the web of material may be damaged by the compressive stress of the support rollers on the web which occurs at the places where the wound roll rests on the support rollers. That stress increases as the wound roll increases in diameter.

This known method of weight relief therefore makes it possible to produce wound rolls of relatively larger diameter, as is required, for instance, in the paper processing industry. However, it also leads to satisfactory results only if the web of material is cut longitudinally into relatively narrow partial webs producing relatively narrow width wound rolls. On the other hand, if at least one wound roll is formed from a relatively wide web, then the above described weight relief acts essentially only at the two ends of the wound roll. This produces a tendency for the wound roll to sag under its own weight. As a result, at the resting points of the roll, the line force in the center of the wound roll is substantially greater than in its two edge regions. Again, there is a risk that the web of material will be damaged in the central region of the wound roll.

In a two roller winding machine, it is known to counteract the weight of the wound roll itself by using a compressed air cushion. In that case, the wound rolls lie close alongside each other on a single roll bed. In this way, a single pressure cushion which supports all the wound rolls can be limited from the outside by relatively simple means (see Federal Republic of Germany 42 04 198). A single roller winding machine is also known which is without roll beds and in which several wound rolls which are isolated from each other are formed on a single central support roller. Each wound roll is guided by two roll brackets. For weight relief, compressed air cushions are provided (see Federal Republic of Germany 42 01 815 A1 and 42 19 415 A1). These known methods, however, cannot be transferred to a three roller winding machine.

SUMMARY OF THE INVENTION

The object of the present invention is to develop the above described method and the corresponding apparatus so that, despite separate production of wound rolls, on two roll beds, their weight can be counteracted by a compressed air cushion. Each of the two roll beds is formed by two support rollers. Each bed includes at least one roller not part of the other bed, and each bed may share a common central roller or may be comprised of its own separate roller pair.

Starting from the method described above, a compressed air cushion is formed, at least in one of the two roll beds, below any desired number of wound rolls and preferably below only the particularly wide rolls. All of the compressed air cushions are limited at their bottom by a longitudinally extending packing element placed in the gap between the two roll support rollers of the one bed. At the same time, in the region of each end of the wound roll, the individual compressed air cushion is limited by placing on an end packing element. The quantity and positions of the end packing elements can be adapted to the quantity and widths of the wound rolls to be supported.

A web winding machine of the invention includes two roll beds each formed of two roll support rollers. Each bed receives a respective web roll being wound thereon. The web rolls are at separate locations across the width of the machine. For at least one roll bed, a longitudinally extending packing is introduced from below into the gap between the two support rollers of the bed. A respective movable packing element is at the end of each wound roll and forms a packing gap with the wound roll and with the wall surfaces of the support rollers to enclose a pressure space. A compressed air cushion can be built up below the wound roll in the bed. At least one of the rollers of the roll bed has a perforated roller shell. A stationary pressure chamber inside the shell delivers pressure through the shell into the pressure space. The pressure chamber in the shell can be divided into sections along the axis of the roller. The pressure chamber is adapted to be connected to a source of compressed air. Brackets for supporting each wound roll are disclosed.

Another aspect of the invention concerns feeding compressed air to the different compressed air cushions which are isolated from each other beneath the roll bed. In principle, compressed air is fed via a pressure chamber, that is divided into sections along the individual roll bed, to each individual compressed air cushion. The pressure chamber preferably extends over the entire length of the roll support roller. The number of sections required in each case and the length of each individual section is adapted to the specific requirements of the case.

The pressure chamber divided into sections as described above is preferably arranged stationary within one of the two roll support rollers. The roller shell of this roll support roller is perforated. Different constructions of such a perforated roll support roller are described in a parallel U.S. patent application Ser. No. 08/804,814 filed by the same inventors on the same date hereof relating to winding a web.

The pressure chamber which is divided into sections can, however, also be arranged below the two support rollers and can form a structural unit with the longitudinally extending packing present between the rollers.

Another possibility for feeding compressed air to the individual compressed air cushions comprises within one of the two roll support rollers, a single pressure chamber that could extend over the entire roller length. Then only certain sections of the roller shell, which are dimensioned in accordance with the partial web widths of the wound rolls, are perforated. This method, however, does not permit subsequent adaptation of the sections to a change in the quantity of wound rolls or to a change in their widths.

For the different wound rolls which are produced on one of the two roll beds, only a single continuous longitudinally extending packing extending over the entire length of the support rollers is necessary. However, for each wound roll to be supported, two end packing elements are necessary. These end packing elements, as is known per se in the case of two roller winding machines, must be removed from their operating positions for the initial winding of each new wound roll. This is necessary because at the start of each winding process for each new wound roll, a roll core or roll tube must be inserted in the bottom of the roll bed. The core or tube is inserted by the guide device and then only gradually travels upward corresponding to the increase in the diameter of the wound roll. Only when the wound roll has reached a given, approximately average diameter, then the end packing elements can be brought into their operating position. Only from this time may a compressed air cushion be built up. This build up is also not necessary earlier because the weight of the wound roll is still slight.

Another aspect of the invention relates to movement mechanisms which permit automatic backward and forward movement of the two end packing elements on the corresponding wound roll which is to be relieved of load. The starting point for such a solution forms the object of the above mentioned Federal Republic of Germany '906. That patent discloses a roll bracket in the region of the two ends of each individual wound roll.

All of the roll brackets are supported on a longitudinal beam which extends above the wound rolls and parallel to the central roll support roller. Each of the roll brackets extends down from the longitudinal beam toward the corresponding roll bed. The roll bed has, for instance, a vertical guide rail which guides one of the guide elements for the roll core or tube.

On each of the two roll brackets of a wound roll, a swingable support arm can be supported which is swingable about an axis of rotation which is approximately parallel to the axes of the support rollers and supports one of the end packing elements at its outer end. It must be seen that the end packing element does not collide either with the roll support rollers or with the roll bracket upon inward or outward swinging. For this purpose, a guide rod is provided on the outer end of the support arm. The end packing element can be removed on the rod from the wound roll and moved from its operating position, which was close to the end of the wound roll, approximately parallel to the axis of the roll. The axis of the guide rod can be inclined with respect to the axis of the wound roll so that the end packing element can be removed from the support rollers at the same time as it is removed from the end of the wound roll. In addition, a lower part of each end packing element can be swung upward so that upon that upward swinging, collision with the adjacent outer roll support roller is avoided. A drive for the swinging process is preferably arranged within that roll bracket.

The construction of a movement mechanism which has just been described has several possibilities. It is particularly suitable where the space available is particularly small, for instance, when two wound rolls are adjacent to each other and there is only a slight distance between them, and they are to be relieved of load in a roll bed by means of a compressed air cushion. In this case, it is necessary to arrange the movement mechanisms for the two end packing elements in a relatively narrow space. In the case of less constricted spaces, a simplified construction can be provided.

For example, an immovable support arm can be fastened, on at least one of the roll brackets instead of a swingable support arm. The immovable arm in turn supports one of the end packing elements at its free end. As described above, this element is then again displaceable relative to the support arm approximately parallel to the axis of the wound roll.

Other features and advantages of the present invention will become apparent from the following description of the invention which refers to the accompanying drawings.

DETAILED DESCRIPTION OF EMBODIMENTS OF THE INVENTION

Figure 1:
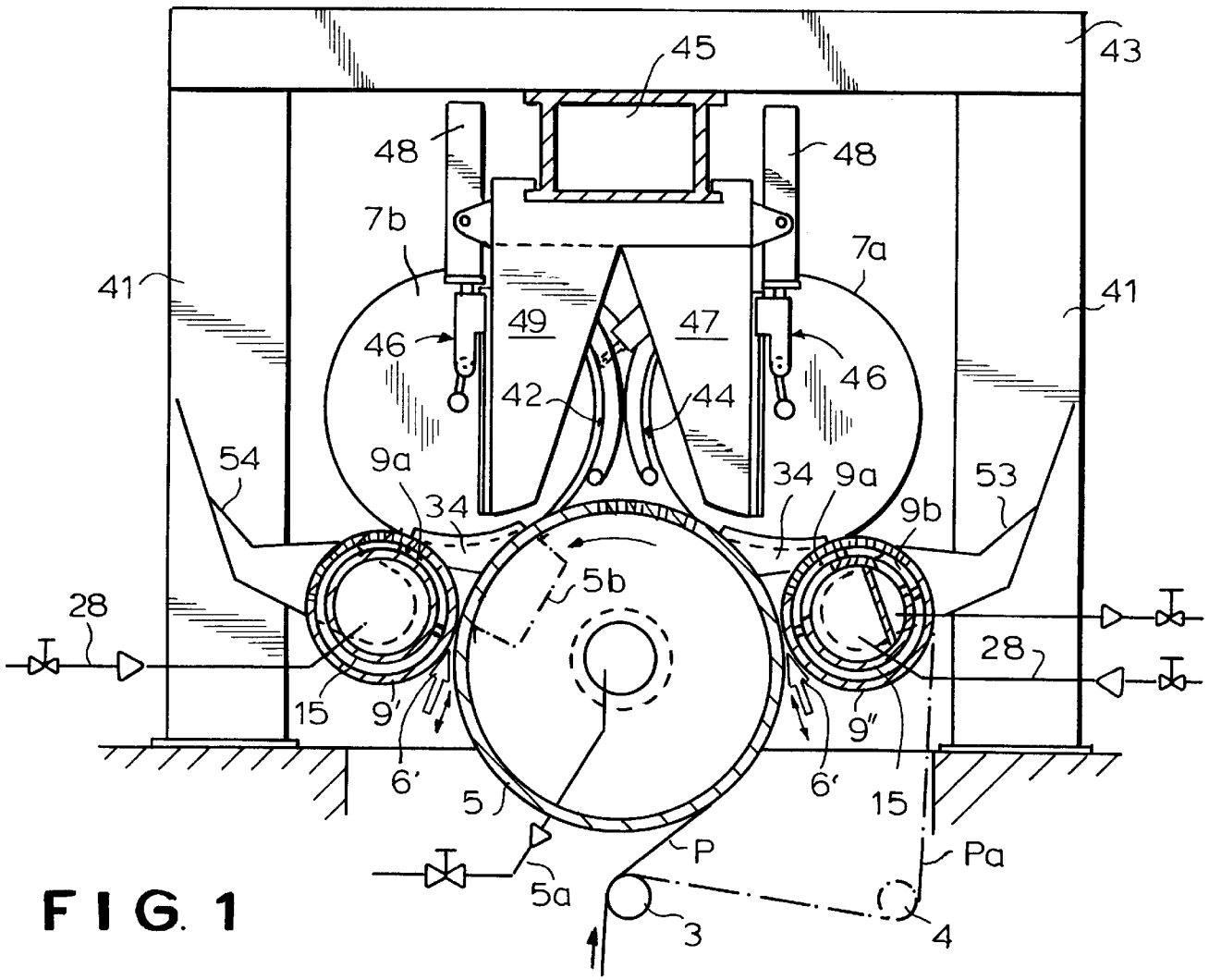
FIG. 1 diagrammatically shows a three roll winding machine.

The winding machine shown in FIGS. 1–4 has a machine frame with stands 41 which are connected together by cross members or beams 43 (FIG. 1). The cross members 43, in turn, are connected in the inside of the machine by a longitudinally extending beam 45. Three wound roll support rollers 5, 9' and 9" are arranged alongside each other and extend parallel to and below the beam 45. The middle roller 5 is part of both roll beds. An alternative would be for each bed to be formed by its own pair of rollers. Each support roller is provided with a drive, not shown. The two outer support rollers 9' and 9" are at the same height and have the same diameter, which is smaller than the diameter of the middle support roller 5. Each two adjacent support rollers form a roll bed so that two beds are present.

The longitudinally cut continuous web of material, for instance a paper web, travels along the path P over the central support roller 5 and into the machine. At least a first one of the longitudinally separated or cut partial webs is rolled on the support rollers 5 and 9' to form a roll 7*a*, while at least one second partial web is rolled over the rollers 9' and 5 to form a roll 7*b*.

In a variant, one can also proceed in the following manner. The longitudinally cut webs are first separated around the circumference of a web guide roller 3 so that the at least one partial web which is intended for a wound roll 7*a* or for several wound rolls along the width of the machine enters the machine along the dot-dash path Pa over another guide roller 4 and over the support roller 9". The other partial web or webs travel, as previously, along the path P over the support rollers 5 and 9' onto the wound roll 7*b*.

Figure 3:
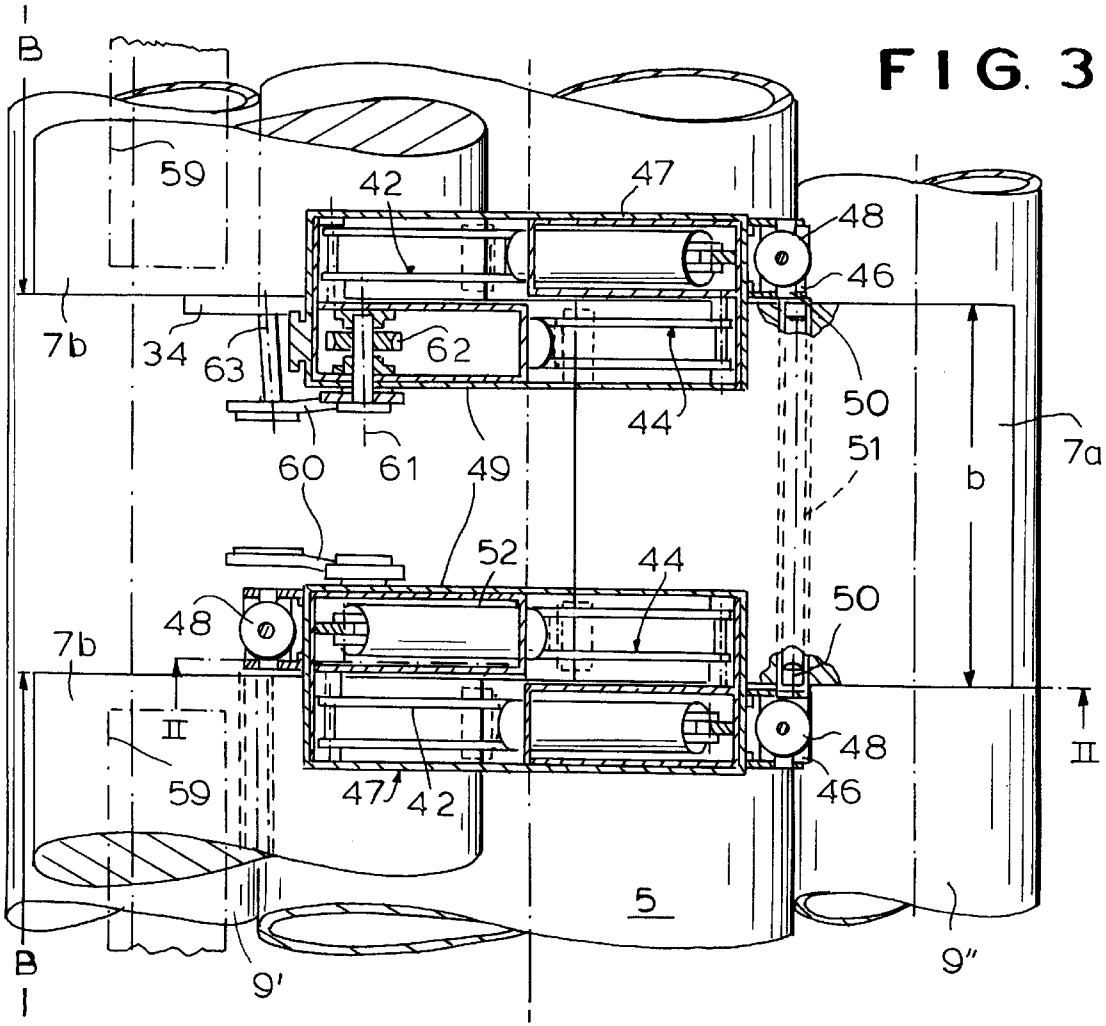
FIG. 3 is a section along the line III—III of FIG. 2.

FIG. 3 shows the following. Because the partial webs alternately enter the two roll beds, there is an axial distance, for instance, between two wound web rolls 7*b* which are produced on the one roll bed. That distance corresponds to the width of the wound roll 7*a* that is being produced on the other roll bed.

Longitudinally displaceable roll brackets 47, 49, are mounted on the longitudinal beam 45. The brackets extend downward into the corresponding roll bed and guide the wound rolls 7*a*, 7*b* on both sides. FIG. 3 shows a pair 47 of roll brackets for the wound roll 7*a* and shows one angle bracket 49 each of two pairs of roll brackets for support of the wound rolls 7*b*. At the place where the end surfaces of two wound rolls 7*a* and 7*b* are axially aligned, the two respective roll brackets 47 and 49 belonging to these two wound rolls form a structural unit.

Each roll bracket 47, 49 has a tube guide 46 which is displaceable vertically by respective lift means 48. Each tube guide 46 supports an axially displaceable clamping head 50 which engages into the center of its wound roll, which is formed by a roll tube 51.

Wound roll ejection devices 42, 44 are located at about the middle support roller 5, and each of those devices is provided with a swing drive 52 for ejecting each of the finished wound rolls 7*a*, 7*b* from the corresponding roll bed. Furthermore, each of the outer support rollers 9' and 9" has an associated roll lowering device 53, 54 by which the ejected finished wound rolls are removed from the machine.

The middle support roller 5 has a perforated roller shell and a suction connection 5*a* preferably in accordance with Federal Republic of Germany 3843246. A vacuum can from time to time be produced within the support roller 5, particularly to hold the new starting ends of the webs to be wound in a roll against the support roller 5 during a change of rolls after the longitudinal cutting of the partial webs from a wider web.

Each of the two outer support rollers 9' and 9" also has a perforated roller shell. Inside each shell there is a stationary air pressure box 15 into which a respective compressed air line 28 transmits air under pressure. The radial space between the roller wall and the compressed air box 15 is divided into selected axial length sections by circumferential direction packings. The number and size of the sections is variable. This enables a compressed air cushion to be built up beneath those wound rolls at which this cushion is considered necessary for relieving the wound roll and the web thereon from the effect of weight in the corresponding roll bed. For this purpose, both roll beds are sealed off from below by means of a respective longitudinally extending packing 6' between the rollers 5 and 9 that define each roll bed and at the bottom of the gap between the rollers. Each packing extends over the entire length of the support rollers. The packing 6' can be removed from below for cleaning purposes and/or for the introduction of the web of material. Longitudinally extending packings are so arranged on the pressure boxes 15 within each of the outer support rollers 9' and 9" that a pressure zone 9*a* develops below the wound roll to be relieved of load. The zone 9*a* extends in circumferential direction from the narrowest gap between the two adjacent support rollers of the roll bed up to the place where the wound roll 7*a* or 7*b* lies on the support roller 9' or 9".

Two lateral end packing elements 34 limit each compressed air cushion produced below a wound roll. These can be placed against the ends of the corresponding wound roll 7*a* or 7*b* or can be inserted below the corresponding wound roll. They form packing gaps with the ends of the wound roll and the ends of the support rollers, closing the pressure space below the roll bed.

The following can be further noted from FIG. 1. If at least one of the partial webs travels along the path Pa to the support roller 9", the pressure box 15 of that roller can be modified to define a suction zone 9*b* around its circumference that can be temporarily connected to a source of vacuum. The escape of compressed air from the middle support roller through the perforations in the region of each compressed air cushion can be avoided, if necessary, by a stationary cover 5*b*. In general, however, the perforations in the shell of the support roller 5 are so fine that even without such a covering, there is no substantial loss of pressure from the compressed air cushions.

Figure 2:
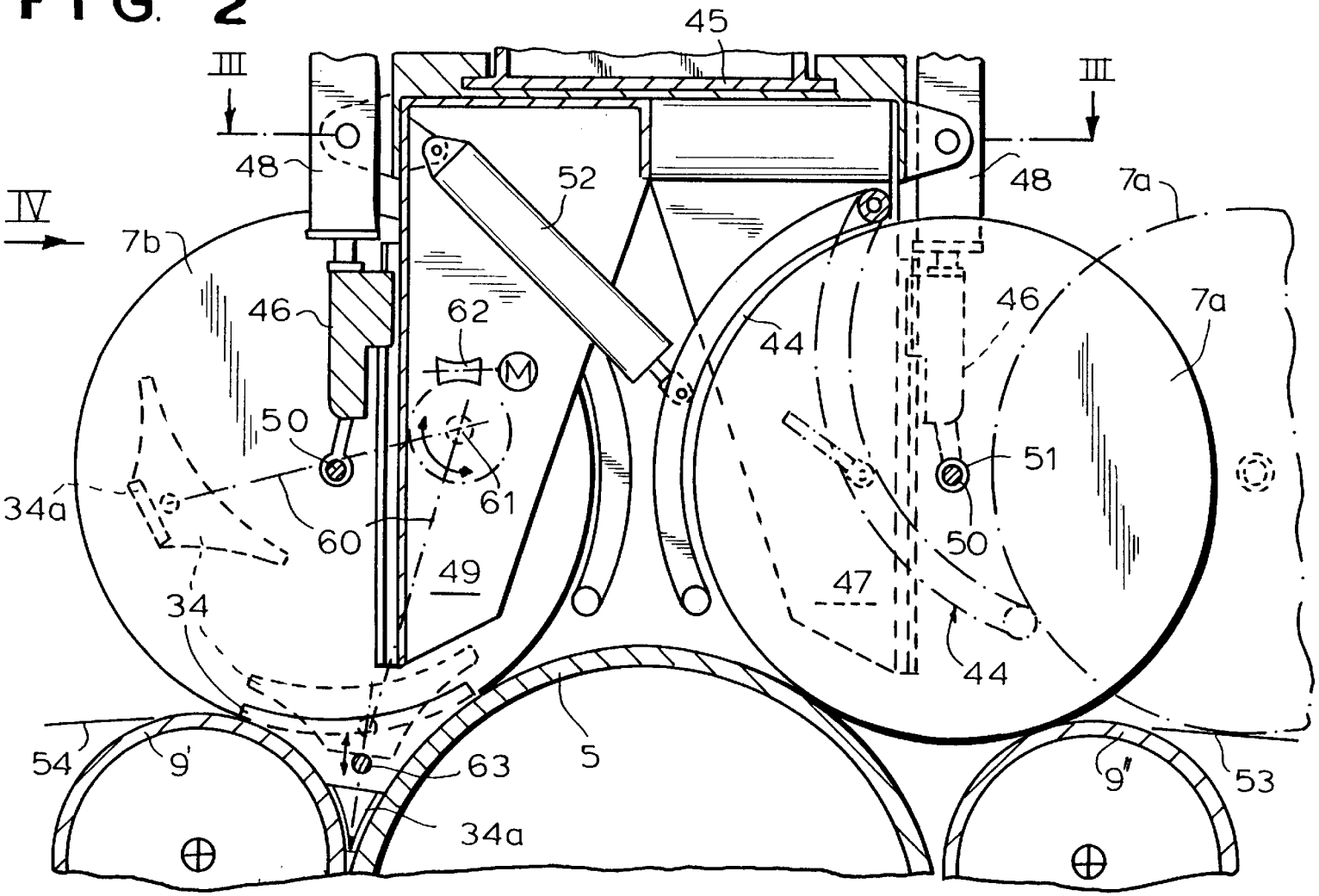
FIG. 2 is an enlarged diagrammatic showing of the region above the two roll beds of the machine shown in FIG. 1, which is a section along the line II—II of FIG. 3.
Figure 4:
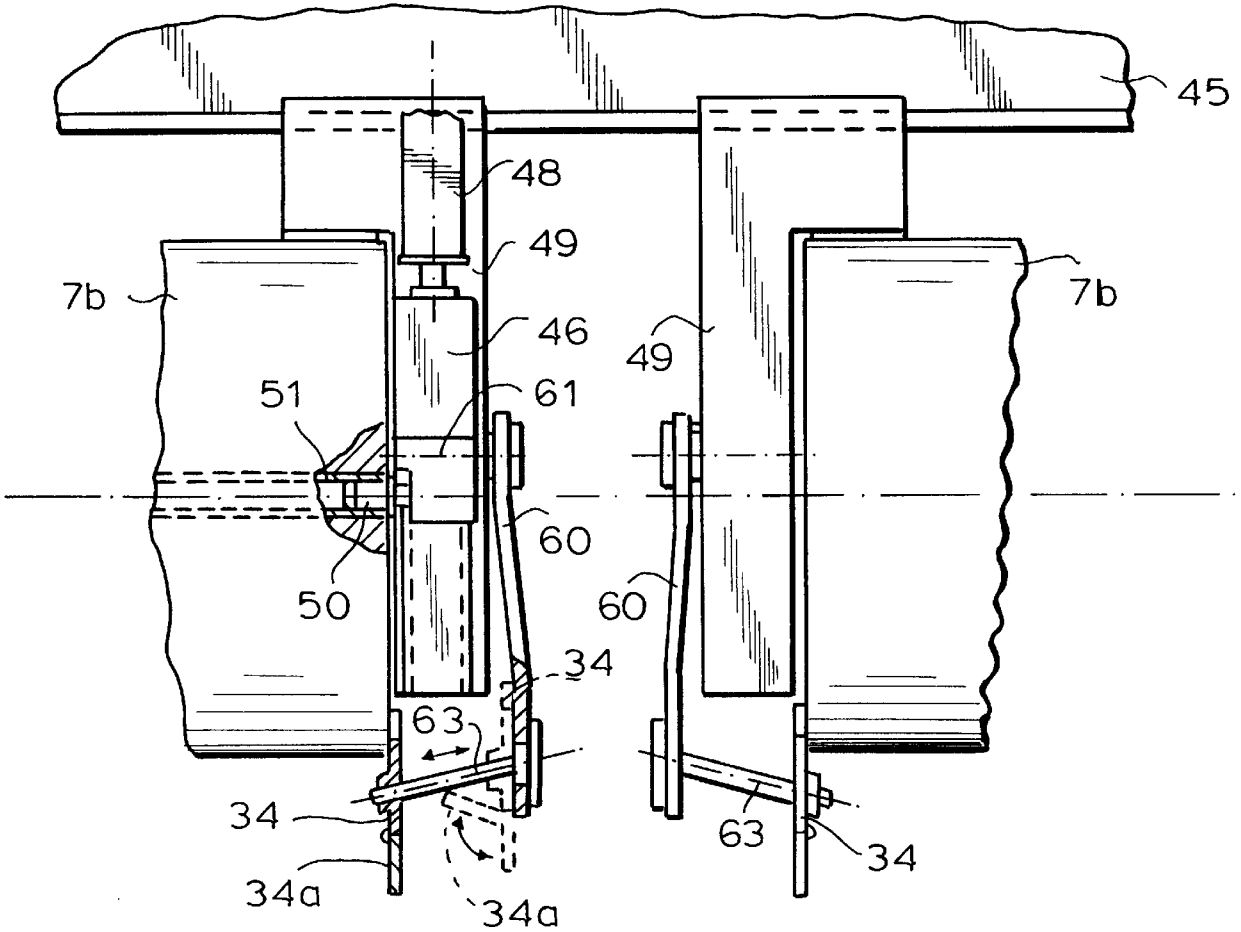
FIG. 4 is a partial view in the direction of the arrow IV of FIG. 2.

FIGS. 2 to 4 show how the end packing elements 34 can be removed from the region of each roll bed. This is necessary because upon initial winding of new wound rolls with the aid of the tube guides 46, new roll tubes must be inserted into the roll beds. At the place where an end packing element 34 must be provided, the respective roll bracket 49 has a support arm 60 having a free end on which the end packing element 34 rests. To set a relatively small spacing between two adjacent wound rolls 7*b*, the support arm 60 is swingable about a pivot axis 61 which is parallel to the axis of the wound roll. There is a swivel drive 62 for the support arm 60.

There is a guide rod 63 on the outer end of the support arm 60. The end packing element 34 can be removed from the wound roll on the rod 63 from its operating position near the end of the wound roll 7*b*. In this connection, in FIG. 4, the end packing element 34 is preferably moved up to behind the end 49*a* of the roll bracket 49 and therefore up into the position shown in dashed line. The axis of the guide rod 63 is approximately parallel to the axis of the roll. As shown in FIG. 4, it can be inclined relative to the axis of the roll.

In this way, as the end packing element 34 is being removed from the end of the wound roll 7*b*, it is also spaced from the support rollers 5 and 9'. In addition, a lower part 34*a* of the end packing element 34 can be swung up as shown in FIG. 4. All of these measures assure that upon the end packing element 34 being removed from the roll bed, it does not interfere either with the support rollers or with the roll bracket.

Supplementing FIGS. 2 and 3, it is assumed here that the web width B of the wound rolls 7*b*, which are only partially visible, is greater than the web width b of the wound roll 7*a* produced between the rolls 7*b*. Therefore, means for producing a compressed air cushion are provided only for the wound rolls 7*b*. Dot-dot-dash lines 59 indicate, the sections of a stationary pressure chamber (for instance 15 in FIG. 1) which are acted on by compressed air. The length of each such section is therefore usually less than the web width B of the wound roll 7*b* which is to be relieved of load. The stationary pressure chambers themselves have been omitted in FIGS. 2 and 3.

Figure 5:
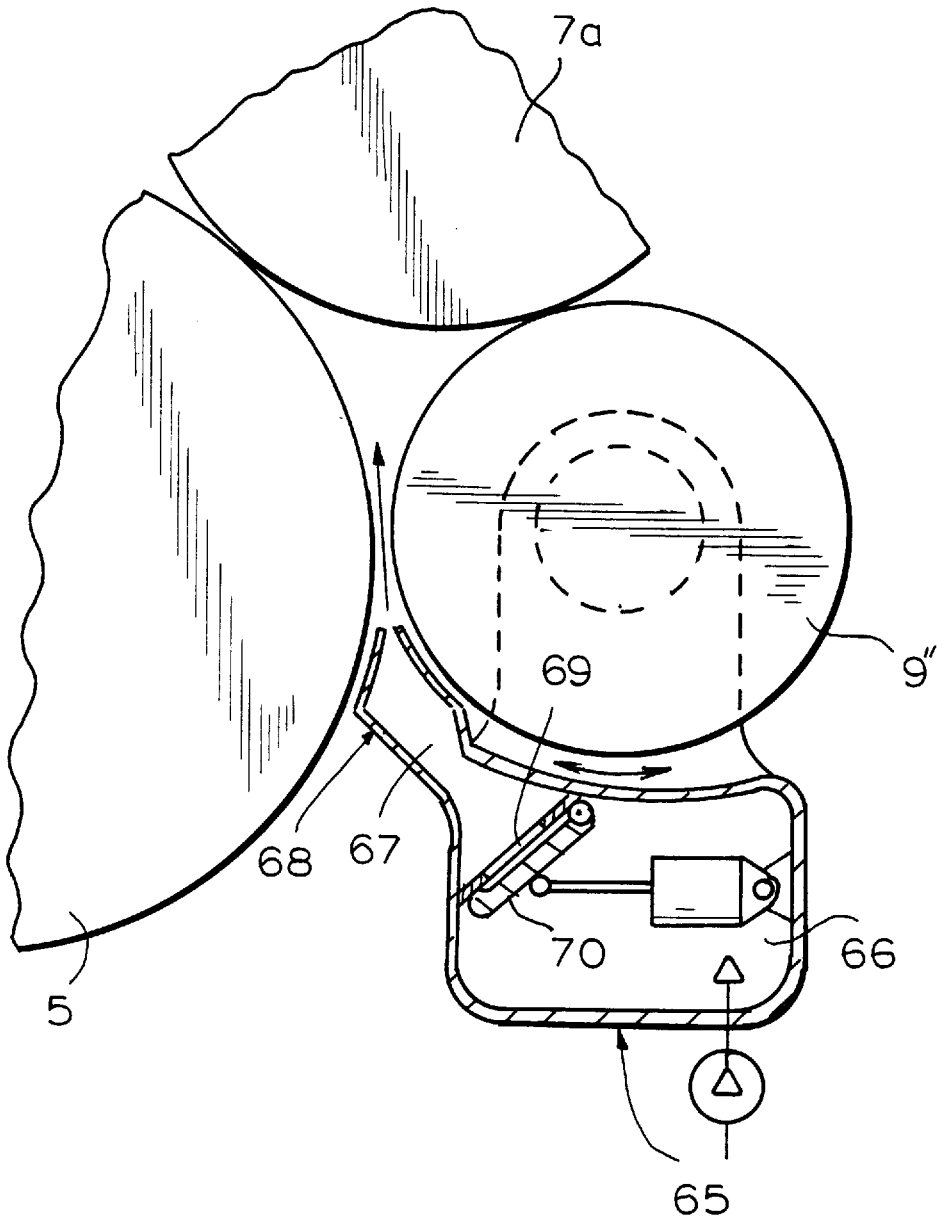
FIG. 5 shows a manner of construction which differs from FIGS. 1–4, including a pressure chamber divided into sections lying below a roll bed.

FIG. 5 shows a construction of a pressure box 65 which differs from the pressure box in FIGS. 1 to 4. The box 65 is arranged below the roll support roller 9", is swingable about its pivot axis and extends substantially over the entire length of the support roller 9". Its inside is divided into a plenum chamber 66 which can be acted on by compressed air and a nozzle chamber 67 by a partition 69 which extends in the longitudinal direction through the entire pressure chamber. The nozzle chamber has a blow-out slot directed into the roll bed and is shaped and sized to form sealing slots with the support rollers 5 and 9". The nozzle chamber thus replaces the longitudinal packing strip 6' shown in FIG. 1. That chamber is divided into a large number of sections by numerous partitions 67 which are spaced at intervals along the axis of the rollers and extend perpendicular to the roller axis. Each section has a respective valve 70 associated with it so that each section can be selectively connected or not, as desired, to the plenum chamber 66. In this way, the feed of compressed air can be controlled to be delivered where it is required, in order to build up a compressed air cushion below a given wound roll 7*a* or 7*b*.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for winding at least two webs of material which are at separate locations in the width direction across the webs, the method comprising:

forming a wound roll of each of the webs on a respective one of two roll beds such that each wound roll is at a respective different location in the width direction and such that at the width location on each roll bed at which a web is wound, there is no roll wound on the other roll bed, wherein each roll bed is comprised of two wound roll support rollers separated by a slot and at least one of the rollers of each of the beds is not a roller of the other bed;

introducing a longitudinally extending packing element extending parallel to the support rollers into the slots present between the two support rollers of each of the roll beds below the respective wound roll on each bed for forming a compressed air cushion for each wound roll in a space limited by the respective longitudinally extending packing element, and further defining the cushion by placing respective packing elements at the opposite ends of each of the wound rolls ends are at different locations in the width direction respectively for each wound roll.

2. The method of claim 1, wherein a respective compressed air cushion is defined at each roll bed below the respective wound roll thereon, and feeding compressed air into the air cushion over axially separate sections along the roll bed corresponding to the separate locations in the width direction of each of the wound rolls.

3. The method of claim 2, wherein the feeding of the compressed air is from the inside of the support roller through a perforated rotatable shell of the roller and into the space below the roll bed.

4. The method of claim 1, further comprising initially winding the rolls on the roll beds and then further winding the rolls on the roll beds;

during initial winding of the rolls, removing the packing elements from the slots between the rollers of each roll bed, and upon further winding of the rolls, placing the packing elements to close the slots.

5. A winding machine capable of winding at least two webs at different width locations across the machine to form at least a first and a second wound roll at the different width locations, such that at the width location on each roll bed at which a web is wound, there is no roll wound on the other roll bed, the machine comprising a first and a second roll bed, a first pair and a second pair of roll support rollers respectively defining the first and second roll beds on which the first and second rolls respectively are wound, the rollers being placed to define a gap between the rollers of each pair;

a respective first and second longitudinally extending packing extending along the length of the support rollers in the between the support rollers of each of the first and second roll beds on which a respective roll is being wound;

a respective packing element at each end of each roll being wound on each roll bed for forming a packing gap with the roll support rollers and with the roll being wound at each roll bed, the roll support rollers and the longitudinal packing of each roll defining a pressure space to be pressurized for relieving pressure on the web on the wound roll on the respective roll bed.

6. The winding machine of claim 5, wherein at least one of the rollers of the first bed has a rotatable perforated roller shell;

a stationary pressure chamber inside the roller shell and opening to the perforated shell, the pressure chamber being connectable to a source of compressed air;

means in the pressure chamber for dividing the pressure chamber into sections axially along the length of the one roller.

7. The winding machine of claim 6, wherein the means for dividing the pressure chamber into sections is adapted for enabling the sections of the pressure chamber to be sized along the length of the one support roller to the width of the web being wound on the wound roll on the one bed.

8. The winding machine of claim 5, wherein at least one of the rollers of each bed has a rotatable perforated roller shell;

a stationary pressure chamber inside the roller shell and opening to the perforated shell, the pressure chamber being connectable to a source of compressed air;

means in the pressure chamber for dividing the pressure chamber into sections axially along the length of the respective roller.

9. The winding machine of claim 8, wherein the means for dividing the pressure chamber into sections is adapted for enabling the sections of the pressure chamber to be sized along the length of the one support roller to the width of the web being wound on the wound roll on the respective roll bed.

10. The winding machine of claim 5, wherein at least two webs are wound at different width locations across the first roll bed and a third web is wound on the second roll bed at a different width location than the first and second webs;

a respective packing element being disposed at each end of each of the at least two rolls being formed on the first roll bed and at each end of the roll being formed on the second roll bed.

11. A method for winding at least two webs of material which are at separate locations in the width direction across the webs, the method comprising:

forming a wound roll of each of the webs on a respective one of two roll beds, wherein each roll bed is comprised of two wound roll support rollers and at least one of the rollers of each of the beds is not a roller of the other bed;

introducing a longitudinally extending packing element extending parallel to the support rollers into a slot present between the two support rollers of at least one of the roll beds below the respective wound roll on that bed for forming a compressed air cushion for the wound roll in a space limited by the longitudinally extending packing element, the cushion being further defined by packing elements associated with the ends of the wound roll;

feeding compressed air into the air cushion over axially separate sections along the roll bed, the feeding of the compressed air is from the inside of the support roller through a perforated rotatable shell of the roller and into the space below the roll bed.

12. A method for winding at least two webs of material which are at separate locations in the width direction across the webs, the method comprising:

forming a wound roll of each of the webs on a respective one of two roll beds by winding the rolls initially and thereafter further winding the rolls, wherein each roll bed is comprised of two wound roll support rollers and at least one of the rollers of each of the beds is not a roller of the other bed;

introducing a longitudinally extending packing element extending parallel to the support rollers into a slot present between the two support rollers of at least one of the roll beds below the respective wound roll that bed for forming a compressed air cushion for the wound roll in a space limited by the longitudinally extending packing element, the cushion being further defined by packing elements associated with the ends of the wound roll;

during the initial winding of the rolls, removing the packing elements from the spaces between the rollers of each bed, and upon the further winding of the rolls, placing the packing elements to close the spaces.

13. A winding machine capable of winding at least two webs at different width locations across the machine to form first and second wound rolls at the different locations, the machine comprising a first and a second roll bed, a first pair and a second pair of roll support rollers respectively defining the first and second roll beds on which the first and second rolls are wound, the rollers being placed to define a respective gap between the rollers of each pair;

in the region of at least one of the first and second roll beds, a longitudinally extending packing extending along the length of the support rollers being introduced into the gap between the support rollers of and below the at least one roll bed on which a roll is being wound;

at each end of the roll being wound on the at least one roll bed, a respective packing element for forming a packing gap with the roll support rollers and with the roll being wound, the roll support rollers and the longitudinal packing defining a pressure space to be pressurized for relieving pressure on the web on the one wound roll;

at least one of the rollers of the first bed having a rotatable perforated roller shell;

a stationary pressure chamber inside the roller shell and opening to the perforated shell, the pressure chamber being connectable to a source of compressed air.

14. The winding machine of claim 13, further comprising means in the pressure chamber for dividing the pressure chamber into sections axially along the length of the one roller.

15. The winding machine of claim 14, wherein the means for dividing the pressure chamber into sections is adapted for enabling the sections of the pressure chamber to be sized along the length of support roller to the width of the web being wound on the wound roll on the one bed.

16. A winding machine capable of winding at least two webs at different width locations across the machine to form wound rolls at the different locations, the machine comprising a first and a second roll bed, a first pair and a second pair of roll support rollers respectively defining the first and second roll beds on which the first and second rolls are wound, the rollers being placed to define a respective gap between the rollers of each pair;

in the region of at least one of the first and second roll beds, a longitudinally extending packing extending along the length of the support rollers being introduced into the gap between the support rollers of and below the at least one roll bed on which a roll is being wound;

at each end of the roll being wound on the at least one roll bed, a respective packing element for forming a packing gap with the roll support rollers and with the roll being wound, the roll support rollers and the longitudinal packing defining a pressure space to be pressurized for relieving pressure on the web on the one wound roll;

a respective roll core for each roll being wound; two respective roll brackets each for guiding the roll core of each wound roll on the respective first and second roll beds, each roll bracket having a support arm;

each support arm includes a free end, one of the packing elements rests against each support arm free end and the packing element is displaceable toward and away from the wound roll by the free end of the support arm.

17. The winding machine of claim 16, wherein at least one support arm is supported so that the free end thereof is movable for displacing the respective packing element approximately parallel to the rotation axis of the wound roll.

18. The winding machine of claim 17, wherein at least one support arm is swingably mounted in the roll bracket on a swivel axis that extends at least approximately parallel to the rotation axis of the wound roll.

19. The winding machine of claim 18, further comprising a part extending into the base of the roll bed beneath the wound roll and swingable up on each end packing element.

* * * * *